United States Patent [19]

Mori

[11] Patent Number: 4,546,715

[45] Date of Patent: Oct. 15, 1985

[54] OVERCASTING ATTACHMENT FOR A SEWING MACHINE

[76] Inventor: Mikio Mori, 12-2, Chidori-cho 3-chome, Ogaki-shi, Gifu-ken, Japan

[21] Appl. No.: 517,284

[22] Filed: Jul. 26, 1983

[30] Foreign Application Priority Data

Aug. 5, 1982 [JP] Japan ..... 57-137033

[51] Int. Cl.[4] ..... D05B 1/20

[52] U.S. Cl. ..... 112/162; 112/245

[58] Field of Search ..... 112/162, 269.1, 245

[56] References Cited

U.S. PATENT DOCUMENTS

| | | | |
|---|---|---|---|
| 180,952 | 8/1876 | Spaulding | 112/262 |
| 732,959 | 7/1903 | Plumley | 112/269.1 X |
| 2,973,730 | 3/1961 | Schweda et al. | 112/162 |
| 3,353,510 | 11/1967 | Reeber et al. | 112/162 |

FOREIGN PATENT DOCUMENTS

| | | | |
|---|---|---|---|
| 82845 | 8/1895 | Fed. Rep. of Germany | 112/162 |
| 815910 | 4/1937 | France | 112/162 |
| 266605 | 5/1950 | Switzerland | 112/162 |

*Primary Examiner*—Wm. Carter Reynolds

*Attorney, Agent, or Firm*—Dennison, Meserole, Pollack & Scheiner

[57] ABSTRACT

The present invention relates to an attachment for a sewing machine, and more particularly to an overcasting attachment for use with a lockstitch sewing machine which is prepared for straight stitching, wherein needle-like thread guide pieces are provided for passing an additionally prepared thread or threads from sideways around the needle point at a suitable time, making use of the vertical reciprocating movement of the needle, so as to engage the thread or threads with the sewing machine threads for straight stitching.

6 Claims, 16 Drawing Figures

OVERCASTING ATTACHMENT FOR A SEWING MACHINE

BACKGROUND OF THE INVENTION

The present invention relates to an attachment for a sewing machine, and more particularly to an overcasting attachment for use with a sewing machine which is prepared for straight stitching, wherein needle-like thread guide pieces are provided for passing an additionally prepared thread or threads from sideways around the needle point at a suitable time, making use of the vertical reciprocating movement of the needle, so as to engage the thread or threads with the sewing machine threads for straight stitching.

SUMMARY OF THE INVENTION

According to the present invention, there is provided an overcasting attachment for use with a sewing machine having a needle bar provided with a needle. The inventive attachment comprises a base plate having an end wall at a part of one lateral end thereof; an L-shaped actuating lever pivoted intermediate the ends thereof to the end wall and having one end thereof slidably pivoted to the needle bar for substantially vertical swinging movement with the needle bar, the other end of the L-shaped actuating lever being movable transversely in a substantially horizontal plane; a transverse-horizontal swing plate operatively connected at one end to the other end of the L-shaped actuating lever for transverse swinging movement in a substantially horizontal plane, the other end of the transverse-horizontal swing plate being pivoted to the base plate at the opposite end remote from the end wall, the transverse-horizontal swing plate having a plurality of transversely deformed elongated slots; a plurality of longitudinal swing members each pivotally connected intermediate the ends thereof to the base plate and having at one end thereof a shanked roller pin slidably engageable with the respective one of the deformed slots; the longitudinal swing members being movable longitudinally in a substantially horizontal plane in acoordance with the respective contour of each of the deformed slots; and at least one needle-like thread guide piece connected to the other end of one of said longitudinal swing members for guiding at least one individually prepared cross thread. With this arrangement, when the L-shaped actuating lever swings in accordance with the vertical reciprocating movement of the needle bar, the respective movement of each of the longitudinal swing members is applied sideways toward the needle at a suitable time during the vertical reciprocating movement of the needle in such a manner that the needle-like thread guide piece guides the individually prepared cross thread to engage the sewing machine threads for straight stitching on the upper and lower surfaces of a cloth so as to produce overcasting stitches. In one embodiment, a thread pulling lever pulls and feeds back the thread at a suitable time in accordance with the vertical reciprocating movement of the needle so that the thread guide piece may pull and feed back the thread while at the same time accomplishing longitudinal swinging movement. In another embodiment, two thread guide pieces are provided, one for an upper cross thread and the other for a lower cross thread. Each of the thread guide pieces has a crooked end on which the cross thread may be carried in a manner forming a bow-shaped configuration with the crooked end so that the needle may pass through the inside of the bow-shaped configuration to ensure engagement of the cross thread with the sewing machine threads.

Accordingly, it is the primary object of the present invention to provide a unique overcasting attachment which is attached to a usual sewing machine to automatically produce overcasting stitches at high speeds.

The present invention will become more fully apparent from the claims and the description as it proceeds in connection with the drawings.

DETAILED DESCRIPTION OF THE PREFERRED EMBODIMENTS

Figure 1:
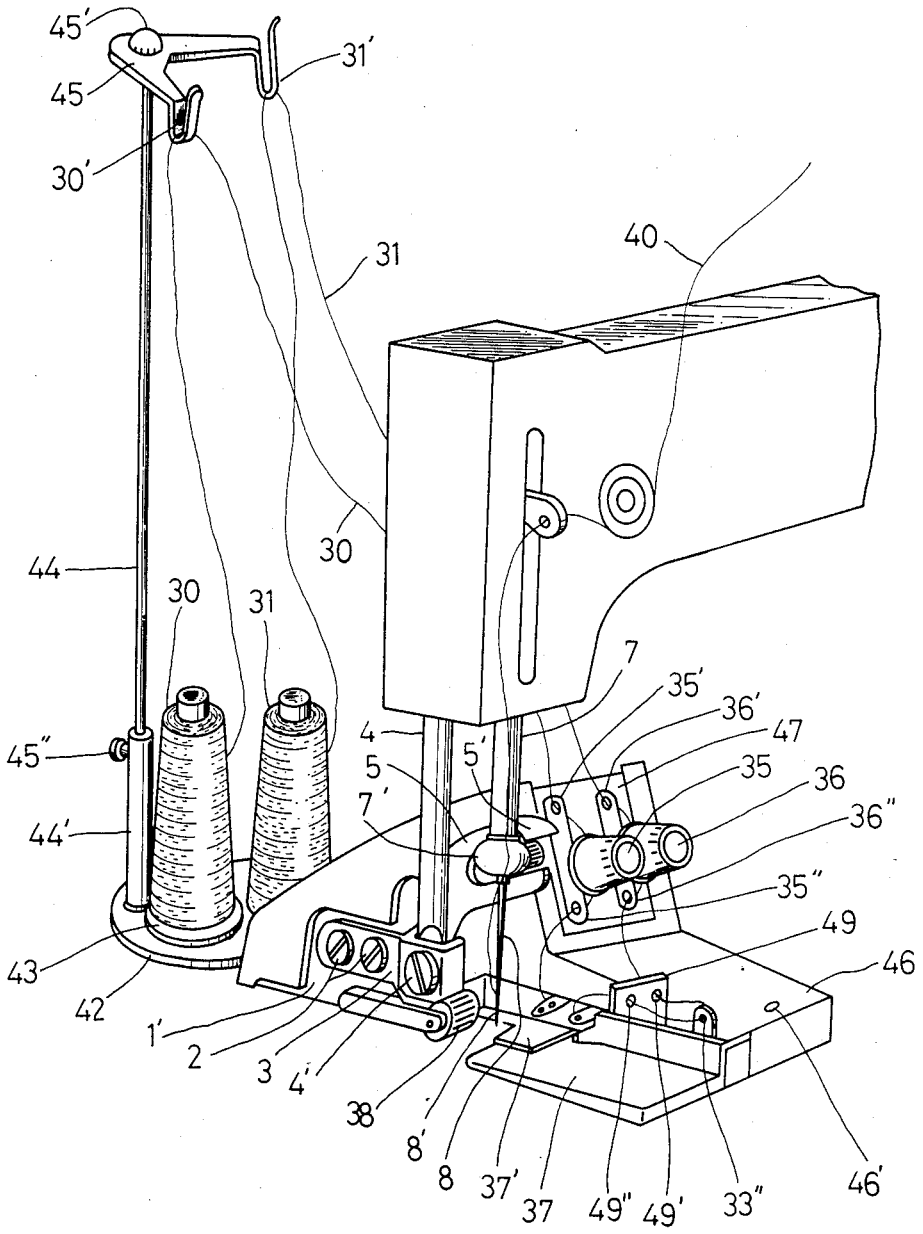
FIG. 1 is a perspective view of an attachment according to one embodiment of the present invention applied to a sewing machine.

Referring now to FIGS. 1 to 4 wherein the first embodiment of the present invention is shown as applied to a sewing machine, reference numeral 1 designates a base plate of the attachment which is of L-shaped configuration in cross section and has an end wall 1'. A fixture 3 is secured to the end wall 1' by set screws 2 and has one end fixedly connected to a presser bar 4 of the sewing machine.

Reference numeral 5 designates an L-shaped actuating lever pivotally connected by a fulcrum pin 6 to the end wall 1' of the base plate 1. The actuating lever 5 has at the extreme end thereof a split opening 5' which is adapted to be engaged with a needle clamp screw 7' of the needle bar 7 for vertical swinging movement.

A connecting lever 9 is carried by the L-shaped actuating lever 5 at the lower portion thereof through a connecting pin 9'. The connecting lever 9 has in the rear portion thereof a connecting aperture 10. There is provided a fan-shaped, transverse-horizontal swing plate 11 having at the extreme end thereof a connecting projection 11'. The connecting projection 11' is engaged with the connecting aperture 10 so as to convert the vertical movement of the needle 8 into the arcuate movement A of the fan-shaped, transverse-horizontal swing plate 11 pivoted to the base plate 1 by a fulcrum pin 12.

The transverse-horizontal swing plate 11 has deformed elongated slots 14, 15, 16 and 17 each having an individual configuration so as to accomplish the operation to suit its respective object. There are provided under the transverse-horizontal swing plate 11 longitudinal swing members 18, 19, 20 and 21 having shanked roller pins 14', 15', 16' and 17' secured thereto in engagement with the slots, respectively, so as to allow the swinging movements of the longitudinal swing members which will be hereinafter described.

Figure 2:
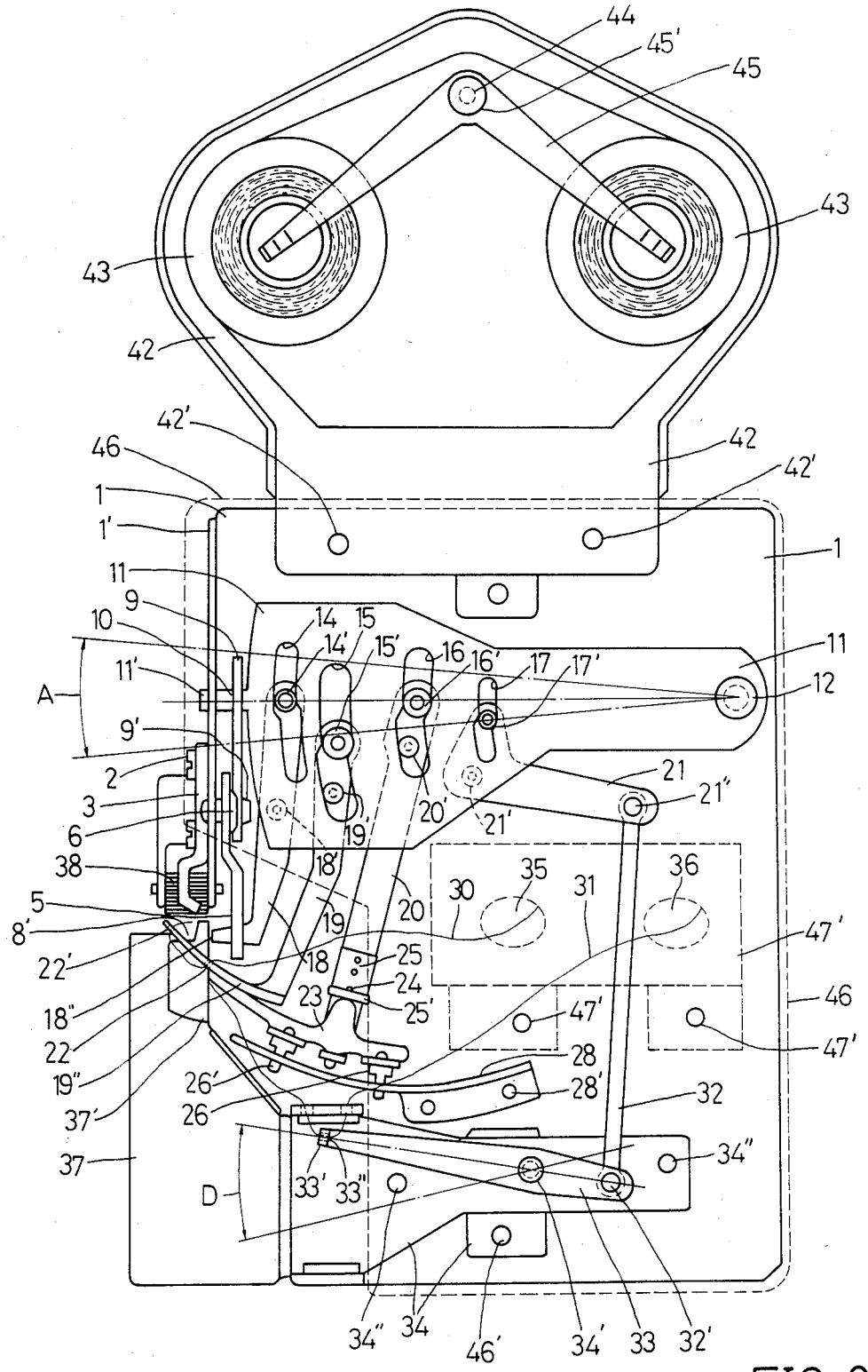
FIG. 2 is a plan view of the attachment with the cover and several parts removed for purposes of illustration.
Figure 10:
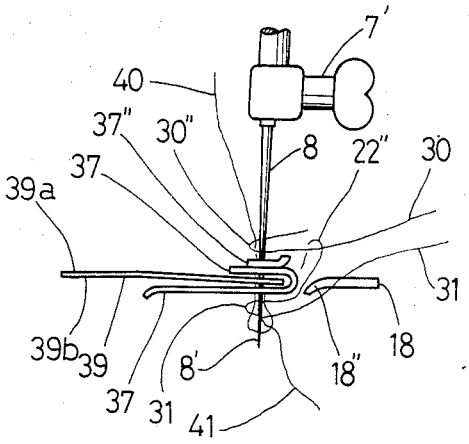
FIG. 10 is a front view in which the extreme end of the thread truing portion serves to support the lower cross thread at a suitable time, to thereby complete four strand stitches.
Figure 11:
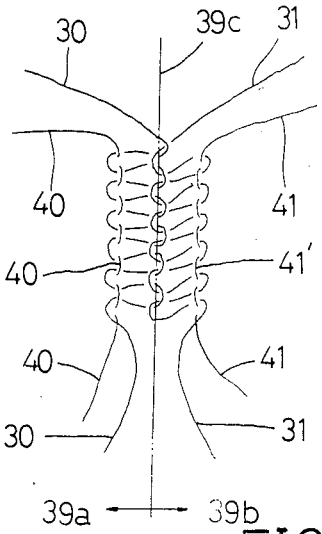
FIG. 11 is a developed view illustrating the four lock-stitched threads engaged with one another on the upper, lower and side surfaces of the cloth in FIGS. 8 and 9.

Referring to FIGS. 2 and 10, the leftmost longitudinal swing member 18 is mounted by a fulcrum pin 18' to the base plate 1 and has at the extreme end thereof a thread truing portion 18'' which is adapted for supporting or releasing an associated, lower cross thread 31 at a suitable time so as to maintain at a constant position the intersection of the lower cross thread 31 with another associated, upper cross thread 30.

Figure 8:
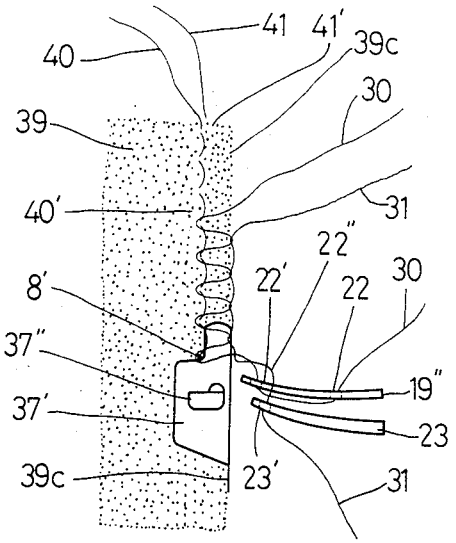
FIG. 8 is a plan view illustrating the overcasting formation through engagement of the upper and lower cross threads with threads for straight stitching, when the guide pieces are at the same positions as those in FIG. 6.
Figure 9:
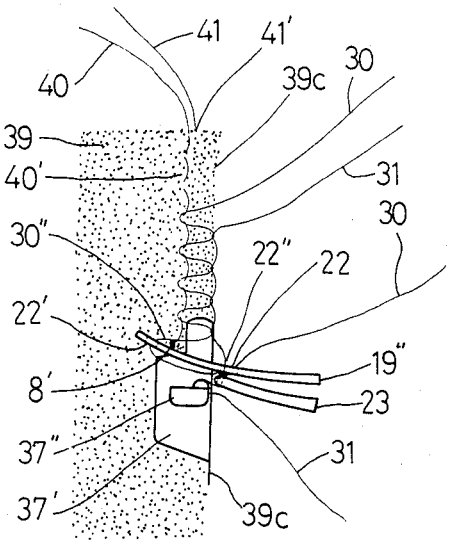
FIG. 9 is a plan view in which the needle passes through the arcuate configuration formed by the cross thread, when the guide pieces are at the same positions as those in FIG. 7.

With continuing reference to FIG. 2, the second longitudinal swing member 19 is mounted by a fulcrum pin 19' to the base plate 1, and has, at its forward end portion, an arcuate, upper cross thread guide piece 19'' having thread holes 22 and 22' and a needle like extreme end. The second longitudinal swing member 19, with the upper cross thread 30 passed through the guide piece 19'', is longitudinally swung at a suitable time so as to engage the upper cross thread 30 with the needle thread 40 passed through the needle 8 on the upper surface **39*a* of the cloth 39 for completing overcasting stitches, as may be seen in FIGS. 7, 8 and 9. At this time, the needle point 8' of the needle 8 passes through an arcuate configuration 30'' defined by the upper cross thread 30 and the guide piece 19'', as best seen in FIG. 9**.

The third longitudinal swing member 20 is mounted by a fulcrum pin 20' to the base plate 1 as shown in FIG. 2, and a lower cross thread guide piece 23, which will be hereinafter described, is attached to the forward end of the third longitudinal swing member 20. As may be seen in FIGS. 4, 5, 6, 7, 8, 9 and 10, the lower cross thread guide piece 23, with the lower cross thread 31 passed through a thread hole 23'' provided at the extreme end 23' thereof, is given vertical swing B so as to form a loop 22'' on the upper side of the upper cross thread guide piece 19''. Then, the lower cross thread 31 is led under the lower surface **39*b* of the cloth 39 to be engaged with the needle point 8' and consequently with the bobbin thread 41** for producing overcasting stitches.

Now the lower cross thread guide piece 23 carried by the third longitudinal swing member 20 will be described with reference to FIGS. 2, 4, 5, 6, 7 and 8. The lower cross thread guide piece 23 imparts on the lower cross thread 31 the longitudinal swing C as well as the vertical swing B, raising and lowering it at a suitable time. When the lower cross thread 31 passed through the thread hole 23'' is brought above the upper cross thread guide piece 19'', the upper cross thread 30 can be passed below the lower cross thread 31.

For this end, the longitudinal swing member 20 has at the front end thereof bearings 25 and 25'. The lower cross thread guide piece 23 has a central support stud 24 which is pivotally received by the bearings 25 and 25', and projecting pins 26 and 26' provided on the right and left sides of the central support stud 24 in front thereof. There is provided an arcuate upright piece 28 having elongated narrow slots 27 and 27' and disposed in such a way that the projecting pins 26 and 26' extend through the slots 27 and 27' so as to move the lower cross thread guide piece 23 like a thread take-up lever and thereby to impart longitudinal swing C and vertical swing B on the extreme end 23' having the thread hole 23''.

The fourth longitudinal swing member 21 is mounted by a fulcrum pin 21' to the base plate 1, and the swinging movement thereof is transmitted to a thread pulling lever 33 so as to pull or push back the lower cross thread 31 at a suitable time for smooth feed thereof conforming to the longitudinal swing C of the thread guide piece 23.

More particularly, a connecting lever 32 is connected at one end to a connecting pin 21'' of the longitudinal swing member 21, and at its the other end to a connecting pin 32' to the thread pulling lever 33 which is carried at a fulcrum pin 34' by a mounting plate 34 secured to the base plate 1 by set screws 34''. The lever 33 has at the extreme end thereof an upright piece 33' having a thread hole 33'' for the lower cross thread 31. The swinging movement of the fourth longitudinal swing member 21 is transmitted to the upright piece 33' in the form of the transverse swing D. (As may be seen in FIGS. 1, 2 and 4, the lower cross thread 31 passes through the hole 33' between two thread holes 49' and 49'' formed in the upper portion of another upright piece 49 of the mounting plate 34.) Thus, the lower cross thread 31 can be pulled or pushed back at a suitable time so as to be accurately engaged with the upper cross thread 30 at the edge **39*c* of the cloth 39** for completing overcasting stitches.

Turning now to FIGS. 1 through 4, reference numerals 35 and 36 designate an upper cross thread tension regulator and a lower cross thread tension regulator, respectively, mounted to a mounting base 47 which in turn is fixed to the base plate 1 by set screws 47'. Each of the thread tension regulators 35 and 36 has two thread holes associated therewith, as generally indicated by numerals 35', 35'' and 36', 36''. The upper cross thread 30 is held by the thread tension regulator 35 through the holes 35', 35'' and led to the thread holes 22, 22', as discussed in the preceding paragraphs, while the lower cross thread 31 is held by the thread tension regulator 36 through the holes 36', 36'' and led to the thread holes 49', 49''.

Reference numeral 37 designates a cloth guide plate having a guide portion 37' extending over a part thereof and generally below the needle 8, to provide a spacing for guiding the cloth 39 therebetween. The guide portion 37' has a thread-truing projection 37'' for maintaining the loop 22'' at a constant position, as may be seen in FIGS. 5, 8 and 9.

Reference numeral 38 is a cloth presser roller fixedly connected to the fixture 3 and extending toward the needle 8 location to guide and hold the cloth 39 in cooperation with the guide portion 37' while the cloth 39 is fed by the feed dog 48 of the sewing machine.

Figure 3:
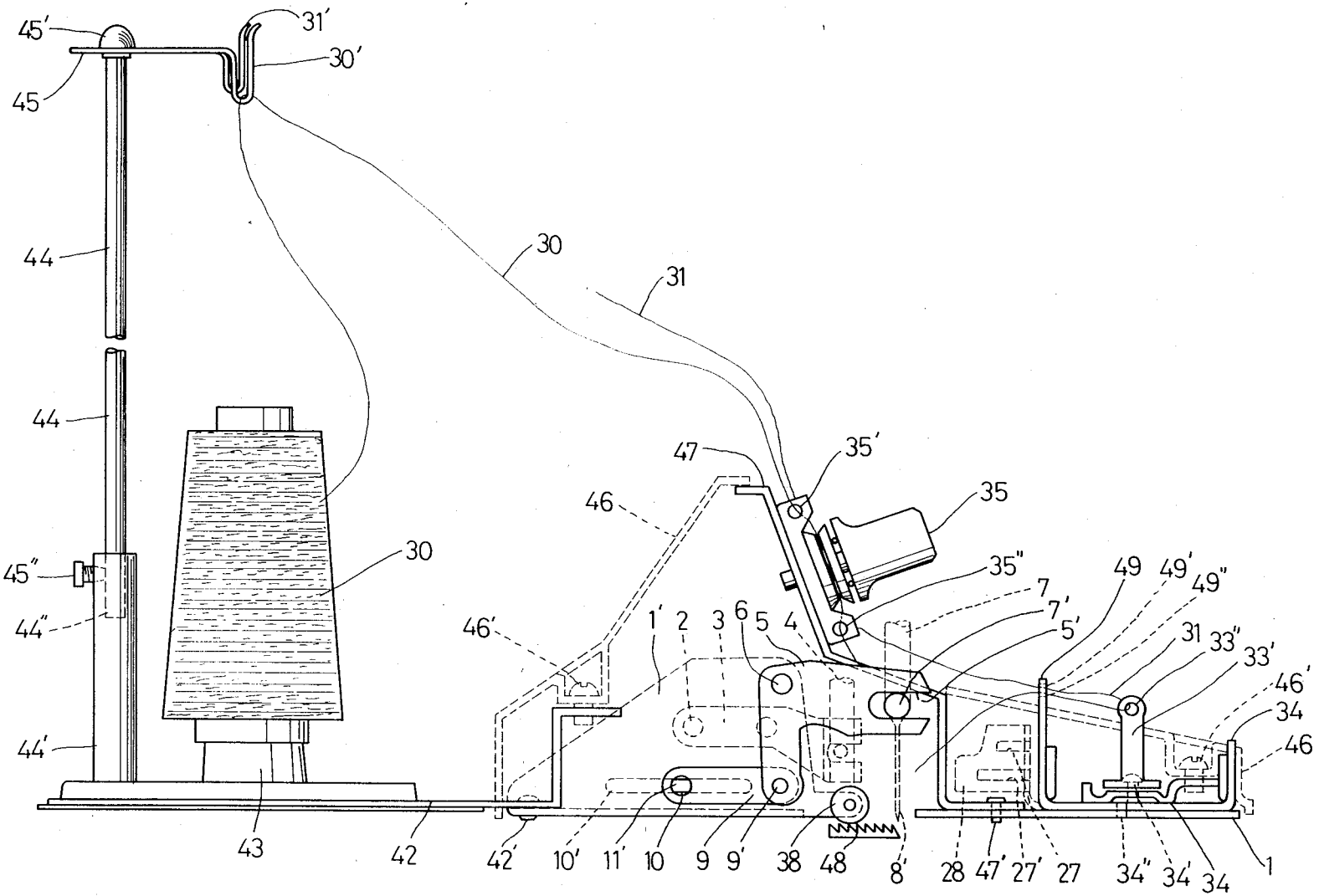
FIG. 3 is a left side elevational view of the attachment with the cover and several parts removed for purposes of illustration.
Figure 4:
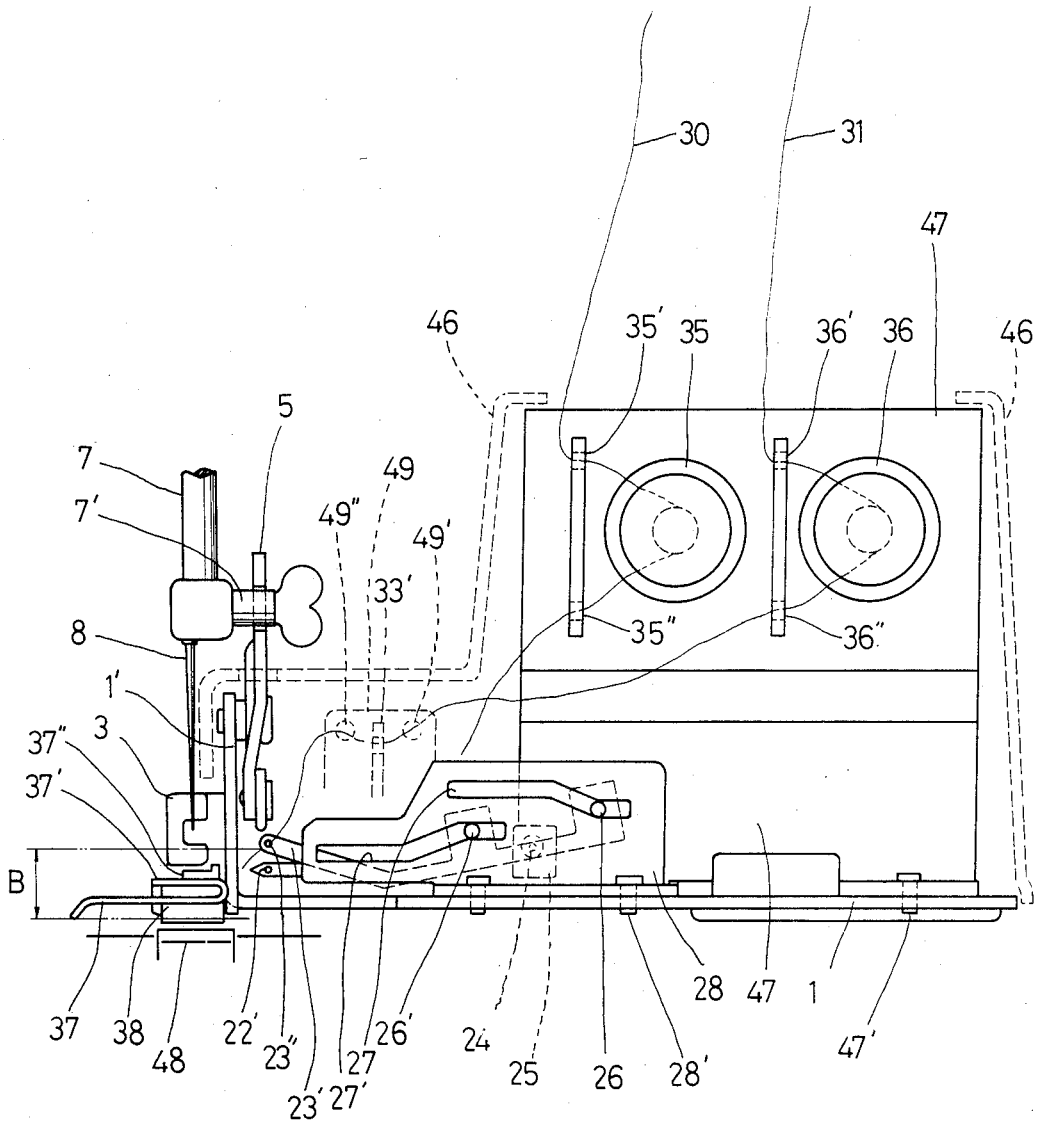
FIG. 4 is a front view of the attachment with the cover and several parts removed for purposes of illustration.

Connected to the rear end of the base plate 1 through set screws 42' is a bobbin holder base 42 having a bobbin holder 43 on which bobbins of threads 30 and 31 are held. The bobbin holder base 42 includes a rod post 44' fixedly connected thereto, which in turn carries a thread guide rod 44 in its hole 44'' through a clamp screw 45''. The thread guide rod 44 has a thread guide fixture 45 connected thereto by a clamp nut 45' and extending substantially horizontally from the top thereof. As generally seen in FIGS. 1 and 3, the thread guide fixture 45 has at its bifurcated free ends a pair of substantially U-shaped thread guide portions 30' and 31' through which the threads 30 and 31 from the bobbins are passed to be led to the respective thread tension regulators 35 and 36.

Further, reference numeral 46 designates a cover for the attachment which is secured to the mounting plate 34 and the bobbin holder base 42 by screws 46'.

In operation, the edge 39*c* of the cloth 39 is fitted into the guide portion 37' of the cloth guide plate 37, and then led under the cloth presser roller 38. When the cloth 39 is fed by the feed dog 48 for straight stitching, the cross threads 30 and 31 engage the needle thread 40 and the bobbin thread 41 from sideways to produce overcasting stitches by four threads, while at the same time the sewing machine produces straight stitches 40' and 41', as has been discussed hereinbefore with reference to FIGS. 5 through 11.

Figure 5:
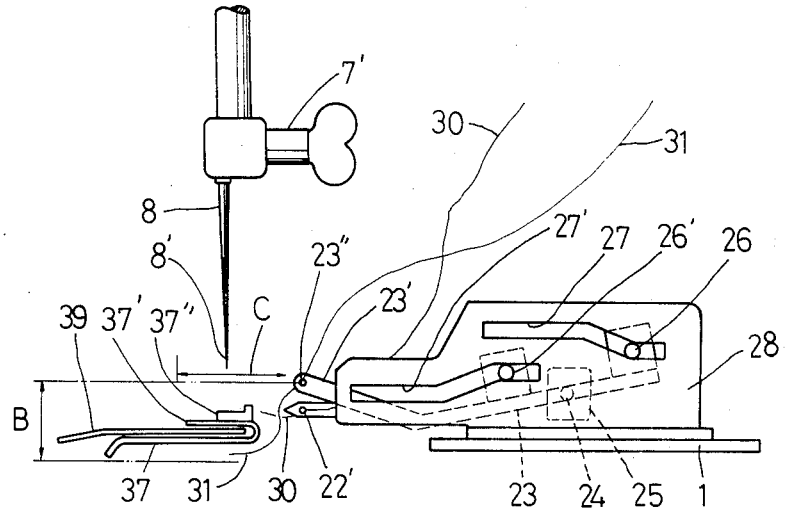
FIG. 5 is a front view in which guide pieces for upper and lower cross threads are disposed at the rightmost position and the threads begin to be engaged with each other.
Figure 6:
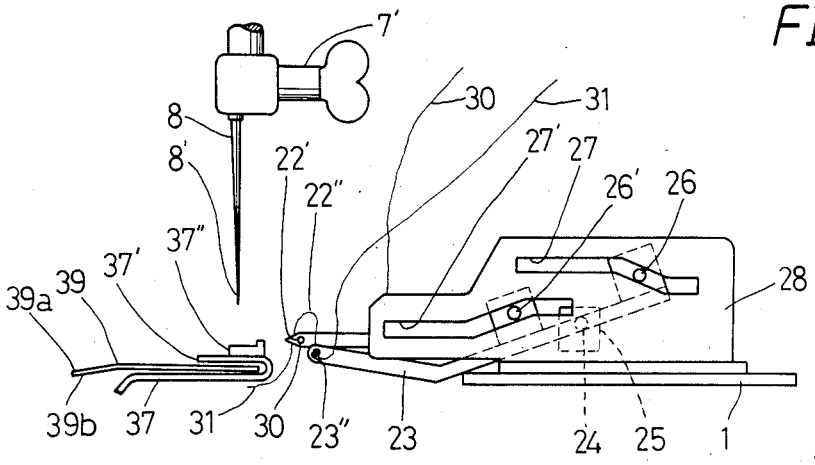
FIG. 6 is a front view in which the guide pieces begin to move to the left and the upper cross thread is passing beneath the lower one.
Figure 7:
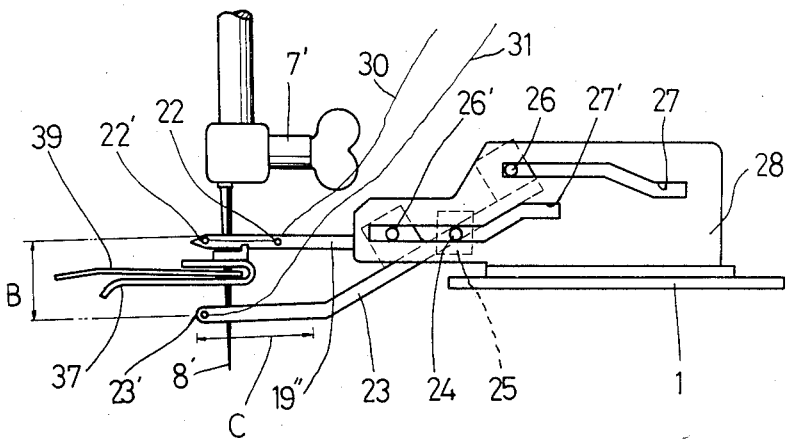
FIG. 7 is a front view in which the guide pieces have advanced to the leftmost position and the upper and lower cross threads are engaged with the needle on the upper and lower surfaces of the cloth, respectively, when the needle has passed through the cloth to the lowermost position.

More particularly, with reference to FIG. 5, the needle 8 is shown in its raised position to start a stitch forming. The hole 23'' of the thread guide piece 23 carrying lower cross thread 31 is located above the hole 22' of the thread guide piece 19'' carrying an upper cross thread 30. In FIGS. 6 and 8, the thread guide piece 23 is lowered to form a loop 22''. In FIGS. 7 and 9, the thread guide pieces 19'' and 23 are moved forward to extend above and below the cloth, respectively. Then the needle 8 comes down. On the upper surface of the cloth the needle thread is locked with the upper cross thread 30 while on the lower surface of the cloth the bobbin thread is locked with the lower cross thread 31. (For clarity, in FIG. 7 the paths of the upper and lower cross threads are not illustrated in great detail. Such paths are best seen in FIG. 10.). Finally, in FIG. 5, as the needle is raised to complete a proper lock stitch, all the four threads are tightened, thereby forming an overcasting stitch.

The attachment described above can be attached to ordinary sewing machines, domestic or industrial, to simply produce overcasting stitches which has been heretofore impossible of formation by those conventional sewing machines, and furthermore, in case a fancy yarn is applied as the upper cross thread 30, fancy overcasting stitches can be produced. Thus, the inventive attachment has unique, superb effects and advantages.

Figure 13:
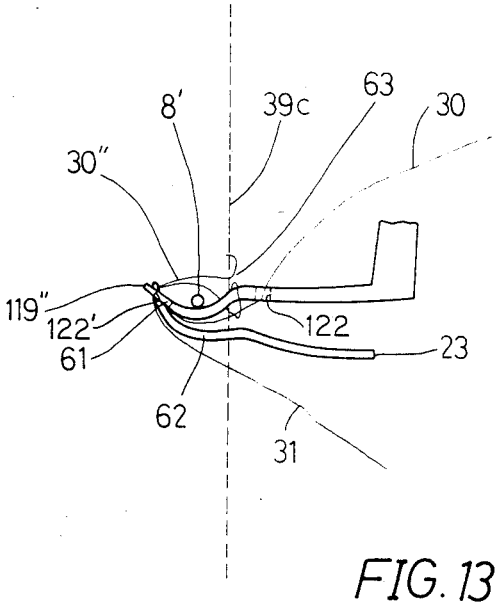
FIG. 13 is a view illustrating a modified configuration of the cross thread guide pieces.

Referring now to FIG. 13, there is shown a modified form of the upper cross thread guide piece 119'' and the lower cross thread guide piece 123. As discussed in the preceding paragraphs, the upper cross thread 30 passes through the holes 122 and 122' of the guide piece 119'' and engages the needle thread and the lower cross thread 31 engages the bobbin thread to produce overcasting stitches. Each of the modified guide pieces 119'' and 123 has a crooked end, as generally indicated by numerals 61 and 62 in FIG. 13, to provide a larger arcuate or bow-shaped configuration through which the needle point 8' passes. Thus, the modified ends of the guide pieces 119'' and 123 ensures the positive hooking engagement of the needle 8 with the cross threads 30 and 31.

Figure 14:
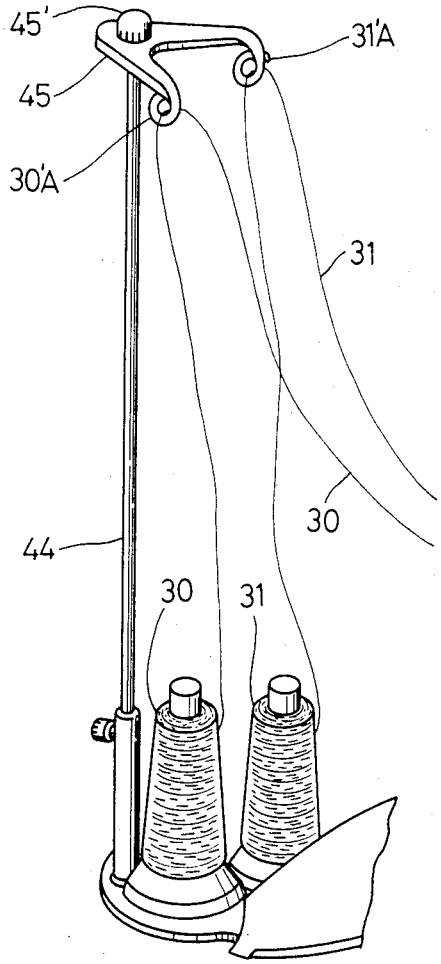
FIG. 14 is a perspective view illustrating a modified configuration of the thread guide portions.
Figure 12:
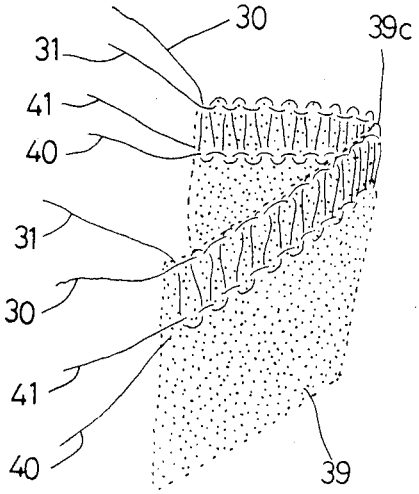
FIG. 12 is a view illustrating the overcasting stitches produced around the edge of the cloth by the attachment according to the present invention.

Further, the thread guide portions 30' and 31' of the thread guide fixture 45 may be rounded to form a spiral configuration, in which case each of the cross threads 30 and 31 may pass through the spiral in a stable and steady condition so as to ensure uniform overcasting performance. Such an modified configuration 30'A or 31'A is illustrated in FIG. 14.

Figure 15:
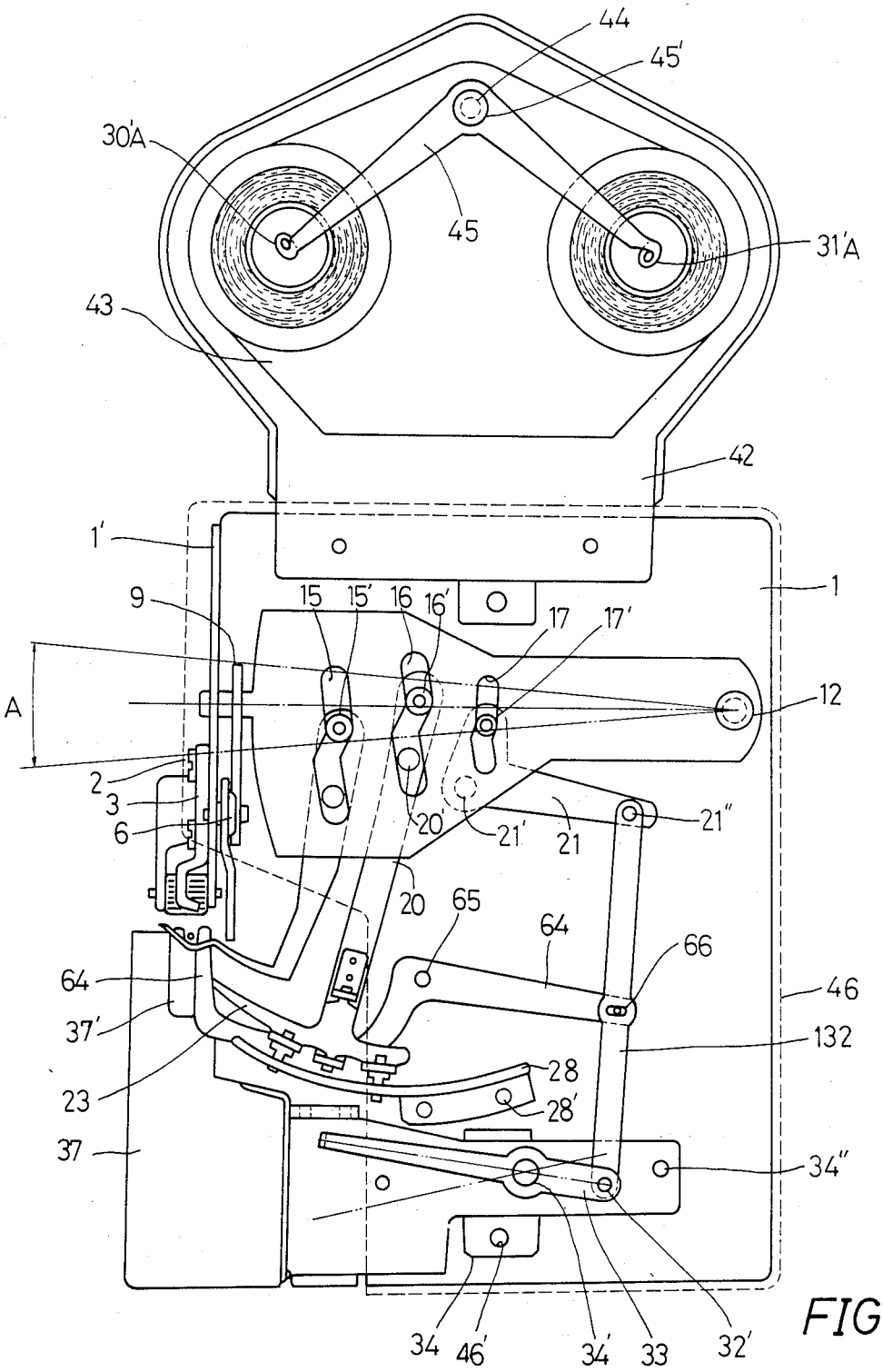
FIG. 15 is a plan view, similar to FIG. 2, of the second embodiment of the present invention.
Figure 16:
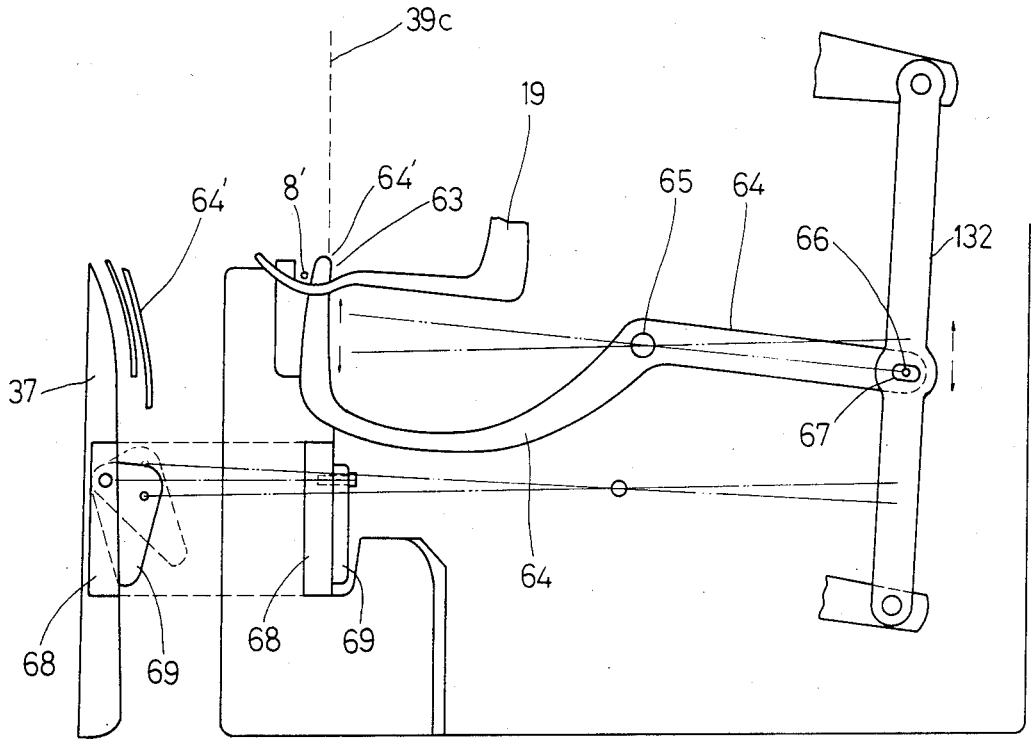
FIG. 16 is a view illustrating the improved thread-truing guide member and the cutter means.

Attention is now directed to FIGS. 15 and 16 which illustrate the second embodiment according to the present invention similar to that shown in FIG. 2. In this embodiment, the deformed elongated slot 14, the longitudinal swing member 18 and the thread-truing projection 37'' are omitted. In FIG. 15, a thread-truing guide piece 64 is connected to a connecting lever 132. Like parts are given like reference numbers.

The thread-truing guide piece 64 is of a generally sickle-like configuration, one end 64' of which being located adjacent the needle point 8', as best illustrated in FIG. 15, and the other end 66 being slidably carried in a hole 67 of the connecting lever 132. The thread-truing guide piece 64 is pivoted at its mid portion to the base plate 1 by a fulcrum pin 65. With this arrangement, the swinging movement of the connecting lever 132 imparts transverse swing movement to the end 64' of the guide piece 64 so as to maintain the mutual intersecting engagement of threads 30 and 31 at a uniform position 63. Thus, it is to be noted that the uniform engagement position 63, where the upper thread 30 intersects the lower thread 31, may provide uniform trim overcasting stitches.

Further, in both the first and second embodiments, the cloth guide plate 37 may be fabricated with a pair of cutters 68 and 69, in which case the first cutter 68 is secured to a part of the cloth guide plate 37 and the second cutter 69 is swingable in tightly contacting engagement with the first cutter 68 to thereby cut and trim the edge 39*c* of the cloth 39, while at the same time the overcasting is being performed.

While the invention has been described with reference to preferred embodiments thereof, it is to be understood that modifications or variations may be easily made without departing from the scope of the present invention which is defined by the appended claims.

What is claimed is:

1. An overcasting attachment for use with a two-threaded sewing machine having a needle bar provided with a needle, comprising:

a base plate having an end wall at a part of one lateral end thereof;

an L-shaped actuating lever pivoted intermediate the ends thereof to said end wall and having one end thereof slidably pivoted to said needle bar for substantially vertical swinging movement with said needle bar, the other end of said L-shaped actuating lever being movable transversely in a substantially horizontal plane;

a transverse-horizontal swing plate operatively connected at one end to the other end of said L-shaped actuating lever for transverse swinging movement in a substantially horizontal plane, the other end of said transverse-horizontal swing plate being pivoted to said base plate at the opposite end remote from said end wall, said transverse-horizontal swing plate having a plurality of transversely deformed elongated slots;

at least a first and a second longitudinal swing member each having a first and a second end portion and each pivotally connected intermediate such end portions to said base plate and having at said first end thereof a shanked roller pin slidably engageable with the respective one of said deformed slots, said longitudinal swing members being movable longitudinally in a substantially horizontal plane in accordance with the respective contour of each said deformed slots; and a first needle-like thread guide piece connected to said second end of said first one of said longitudinal swing members for guiding an individually prepared upper cross thread;

a second needle-like thread guide piece connected to the other end of said second one of said longitudinal swing members for guiding an individually prepared lower cross thread;

so that when said L-shaped actuating lever swings in accordance with the vertical reciprocating movement of said needle bar, the respective movements of said longitudinal swing members are applied sideways toward the needle at a suitable time during the vertical reciprocating movement of the needle in such a manner that said first and second needle-like thread guide pieces guide said individually prepared upper and lower cross threads, respectively, for engagement with the machine threads for straight stitching on the upper and lower surfaces of a cloth so as to form overcasting stitches.

2. An overcasting attachment for sewing machines as defined in claim 1 further comprising an upright piece fixedly connected to said base plate and having elongated slots of predetermined contours, said second needle-like thread guide piece having pins engageable with said slots so that the extreme end of said second needle-like thread guide piece swings in a substantially vertical plane.

3. An overcasting attachment for sewing machines as defined in claim 1 further comprising at least a third longitudinal swing member having a roller pin on one end thereof and a thread-pulling lever operatively connected to said third longitudinal swing member such that the swinging movement of the roller pin on said third longitudinal swing member causes an amplified swinging movement of said thread-pulling lever, so that the amplified swinging movement of said thread-pulling lever causes said second thread guide piece to pull and feed back the lower cross thread at a suitable time while said second thread guide piece swings substantially longitudinally in a horizontal plane.

4. An overcasting attachment for sewing machines as defined in claim 1 wherein said first and second cross thread guide pieces each has a crooked end on which the respective cross threads may be carried in a manner forming a substantially bow-shaped configuration with the crooked end, so that the needle passes through said bow-shaped configuration to ensure engagement of the upper and lower cross threads with the sewing machine threads.

5. An overcasting attachment for sewing machines as defined in claim 1 further comprising a cloth guide means disposed generally below the needle of the sewing machine, and an L-shaped thread-truing guide piece pivotally connected to said base plate and having one end disposed generally above said cloth guide means for unifying the position where the upper cross thread intersects the lower cross thread.

6. An overcasting attachment for sewing machines as defined in claim 1 further comprising a cloth guide means disposed generally below the needle of the sewing machine, and a pair of cutters secured to a part of said cloth guide means for cutting and trimming the edge of a cloth being stitched.

* * * * *